United States Patent [19]

Bushnell et al.

[11] 4,125,458

[45] Nov. 14, 1978

[54] SIMULTANEOUS DEASPHALTING-EXTRACTION PROCESS

[75] Inventors: James D. Bushnell, Berkeley Heights, N.J.; Alexandr P. Glivicky, Sarnia, Canada; Milton D. Leighton, Florham Park, N.J.; Bruce M. Sankey, Sarnia, Canada

[73] Assignee: Exxon Research & Engineering Co., Linden, N.J.

[21] Appl. No.: 863,585

[22] Filed: Dec. 22, 1977

Related U.S. Application Data

[63] Continuation-in-part of Ser. No. 847,014, Oct. 31, 1977, abandoned, which is a continuation of Ser. No. 683,376, May 5, 1976, abandoned.

[51] Int. Cl.[2] ..... C10G 21/04

[52] U.S. Cl. ..... 208/309; 208/321; 208/323

[58] Field of Search ..... 208/309, 321, 323

[56] References Cited

U.S. PATENT DOCUMENTS

| | | | |
|---|---|---|---|
| 3,291,718 | 12/1966 | Biribauer et al. | 208/309 |
| 3,779,895 | 12/1973 | Wilson et al. | 208/309 |
| 3,779,896 | 12/1973 | Woodle | 208/309 |
| 3,816,295 | 6/1974 | Coleman et al. | 208/86 |

FOREIGN PATENT DOCUMENTS

| | | | |
|---|---|---|---|
| 613,224 | 1/1961 | Canada | 208/323 |

*Primary Examiner*—Herbert Levine
*Attorney, Agent, or Firm*—Edward M. Corcoran

[57] ABSTRACT

An asphalt containing mineral oil is simultaneously deasphalted and extracted in a combination zone by contacting the oil with a solvent comprising N-methyl-2-pyrrolidone (NMP) containing from 0–5 LV% water and a light hydrocarbon to produce a raffinate and extract phase, with the raffinate phase containing the desired oil, most of the hydrocarbon solvent and some NMP. The raffinate is then passed to a reduced pressure zone to remove most of the hydrocarbon solvent therefrom. The remaining raffinate oil and NMP solution is then chilled to produce bulk liquid-liquid immiscibility between the oil and NMP. The chilled oil and NMP are then passed to a settling zone wherein the NMP is separated from the oil and recycled back into the combination zone.

11 Claims, 1 Drawing Figure

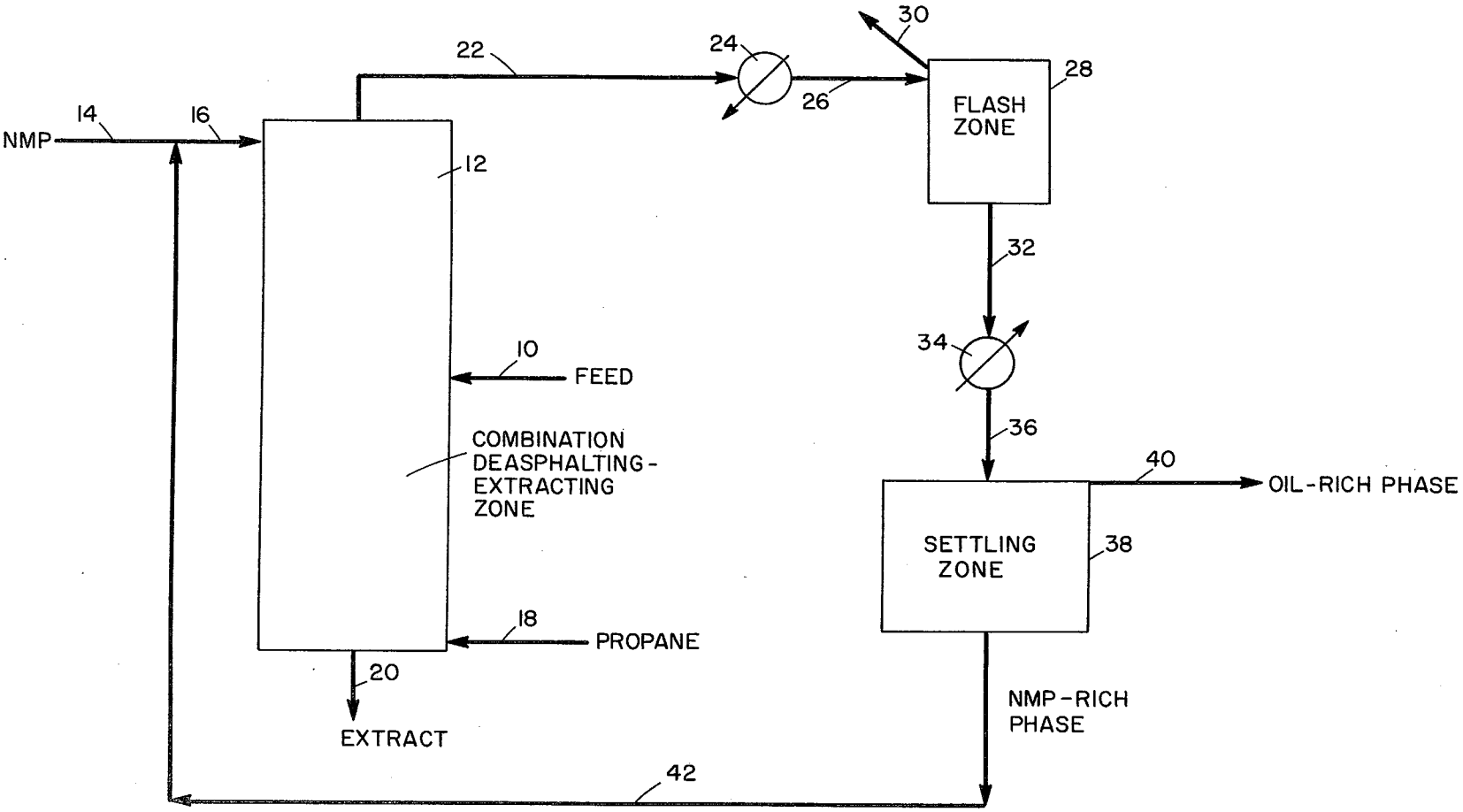
OIL-RICH PHASE
40
38
SETTLING ZONE
NMP-RICH PHASE
28
FLASH ZONE
32
36
34
30
26
24
42
PROPANE
18
FEED
10
COMBINATION DEASPHALTING-EXTRACTING ZONE
22
12
20
EXTRACT
16
14
NMP

SIMULTANEOUS DEASPHALTING-EXTRACTION PROCESS

CROSS REFERENCE TO RELATED APPLICATIONS

This is a continuation-in-part of copending U.S. Ser. No. 847,014, filed on Oct. 31, 1977, which was a continuation of U.S. Ser. No. 683,376, filed on May 5, 1976, both now abandoned.

BACKGROUND OF THE INVENTION

1. Field of the Invention

This invention relates to a process for simultaneously deasphalting and extracting an asphalt containing mineral oil and recovering the extraction solvent. More specifically, this invention is a process for simultaneous solvent deasphalting and extracting a mineral oil containing asphaltic and aromatic components in a combination zone which comprises contacting said oil with a solvent comprising a mixture of a light hydrocarbon and N-methyl-2-pyrrolidone (hereinafter referred to as NMP for the sake of brevity) to produce raffinate and extract phases, separating the solvent from the raffinate phase and recycling the separated solvent back to the combination zone. Still more particularly, the present invention is a process for simultaneously solvent deasphalting and extracting a petroleum oil containing asphaltic and aromatic components which comprises contacting the oil, in a combination zone, with a solvent comprising a mixture of (a) at least one liquid, low molecular weight $C_2$–$C_{10}$ carbon atom hydrocarbons and (b) NMP containing from about 0–5 LV% water to produce raffinate and extract phases with the raffinate phase containing the desired oil, most of the hydrocarbon solvent and some NMP, heating the solvent containing raffinate to flash off most of the hydrocarbon solvent therefrom followed by chilling the hydrocarbon solvent reduced raffinate to produce bulk liquid-liquid immiscibility between the NMP and the raffinate oil, separating the NMP from the oil and recycling the NMP back into the combination zone.

2. Description of the Prior Art

It is well known to those skilled in the art to deasphalt asphalt-containing mineral oils with light or low molecular weight hydrocarbons such as propane, especially in the preparation of lubricating oils from resids and crude oils. In such a process, an oil feedstock or stream containing asphaltic type constituents is mixed with a light hydrocarbon, such as liquid propane, under temperature and pressure conditions whereby the asphaltic type constituents are precipitated. After separation of the asphaltic type constituents from the deasphalted oil, the respective streams are handled in well known manners in order to recover the solvent. It is also well known to those skilled in the art to treat certain types of oil feedstocks, particularly distillate lube oil feedstocks, with various solvents in order to separate the relatively more aromatic and polar type constituents having low VI, from the relatively more paraffinic type constituents having high VI. The more commonly employed extraction solvents useful in such processes include phenol, various cresols, furfural, sulfur dioxide, and more recently, solvents such as NMP along with minor amounts of water. In such extraction operations the oil is contacted with a solvent such as phenol, containing minor amounts of water, either in a countercurrent treating operation or in a multistage batch operation under temperature and pressure conditions designed to secure phase separation. As a matter of practice, the oil to be treated is usually introduced into one end of a countercurrent treating zone while a solvent or solvent mixture is introduced at the other end. The solvent and oil flow countercurrently under temperature and pressure conditions to produce a raffinate phase and an extract phase. The solvent rich extract phase is withdrawn from one end of the countercurrent treating zone and contains most of the aromatic and polar components of relatively low VI, while the oily or solvent poor raffinate phase, containing the more paraffinic, high VI type constituents is withdrawn from the other end of the treating zone. The respective streams are then handled in well known manners to separate and recover the solvent.

Another process well known to those skilled in the art is the Duo-Sol process for the extraction of high VI, light color, low carbon residue lube base stocks from either residual or distillate lube feeds. This is a simultaneous deasphalting-extraction process which derives its name from the use of two solvents. The solvents employed are propane and a blend of cresol and phenol. The propane preferentially dissolves a relatively high VI, paraffinic type of lube base stock from the feed, while the cresol and phenol preferentially dissolve the asphalt, undesirable aromatics, polars and color bodies from same as an extract. The combination lube process disclosed in U.S. Pat. No. 3,291,718 incorporates a Duo-Sol extraction deasphalting operation, wherein a suitable feed such as an atmospheric resid is fed into the middle of a deasphalting-extraction zone, while propane is fed into the bottom and phenol is fed into the top to produce a deasphalted raffinate phase relatively low in aromatics and polars and from which useful, high VI lube oils are made. NMP has recently been suggested as useful for deasphalting and for simultaneous deasphalting-solvent refining. In U.S. Pat. No. 3,779,895, NMP is suggested as being a member of a group of solvents consisting of low molecular weight paraffins containing 3–10 carbon atoms, NMP and furfural, for deasphalting aqueous dispersions of heavy petroleum fractions which have been pretreated with high temperature steam. Finally, in U.S. Pat. Nos. 3,779,896 and 3,816,295, lube oils are prepared by subjecting a residuum-containing petroleum fraction to simultaneous deasphalting-solvent refining using either furfural or NMP as the combination deasphalting-solvent refining solvent and most preferably NMP, because of its greater thermal stability and solvent capacity.

Therefore, because the disclosures in the prior art have not suggested using a combination of NMP and light hydrocarbon solvents for simultaneously deasphalting and extracting an asphalt-containing oil, it was not known whether or not such a system would work. Hence, when it was found that this system would work, U.S. patent application Ser. No. 683,376 (now abandoned) was filed claiming such a process. However, it was further discovered that the raffinate produced by this process contained excessive amounts of NMP which meant that a method had to be found for separating the NMP from the raffinate phase and recycling the NMP back into the combination deasphalting-extracting zone in order to make the combination process economically viable.

SUMMARY OF THE INVENTION

The present invention is a process for simultaneously solvent deasphalting and extracting a mineral oil feedstock containing asphaltic and aromatic components which comprises the steps of:

(1) contacting said feedstock, in a combination deasphalting-extracting zone, with a solvent comprising a mixture of (a) NMP containing from 0–5 LV% water and (b) one or more liquid, low molecular weight $C_2$–$C_{10}$ carbon atom hydrocarbons to form two layers or phases, an upper, raffinate phase containing the desired oil, most of the hydrocarbon solvent and some NMP and a lower, extract layer or phase containing asphalt, most of the NMP and some hydrocarbon solvent;

(2) removing the raffinate from said combination zone and heating same to a temperature ranging from between about 180°–450° F.;

(3) passing said hot raffinate from step (2) to a flash zone to remove most of the hydrocarbon solvent therefrom as vapor and produce a hydrocarbon solvent-reduced raffinate;

(4) chilling said hydrocarbon solvent-reduced raffinate to a temperature sufficiently low to produce bulk liquid-liquid immiscibility between the raffinate oil and the NMP, thereby forming two phases or layers, an oil-rich light phase and an NMP-rich heavy phase containing some oil and most of the NMP present in the raffinate formed in step (1);

(5) separating the oil-rich phase from the NMP-rich phase; and (6) passing said NMP-rich phase back into said combination zone. The oil-rich light phase containing the desired raffinate oil may then be further processed.

The combination deasphalting-extraction solvent used in the instant invention comprises a liquid mixture of (a) $C_2$–$C_{10}$ carbon atom hydrocarbons ranging from ethane or ethylene to decane and mixtures thereof and (b) NMP containing from 0–5 LV% water. Minor amounts of other hydrocarbons may be present in the solvent without substantially affecting the overall efficiency of the process. Preferably, the hydrocarbon comprises low molecular weight paraffins containing 3–10 carbon atoms and mixtures thereof and most preferably 3 carbon atom hydrocarbons such as propane. A particularly preferred solvent is a mixture of propane and NMP containing about 0–2 LV% water based on the NMP content thereof. The volume ratio of the light, low molecular weight hydrocarbon to the NMP will range from 2/1 to 6/1 depending upon the hydrocarbon and the oil feed. An illustrative but non-limiting example is a mixture of (a) NMP containing 1 LV% water and (b) propane, wherein the volume ratio of propane to NMP is 2.5/1. The amount of deasphalting-extraction solvent employed and the operating temperatures and pressures utilized must be controlled to suit the particular solvent composition used and the oil feedstock being treated in order to obtain a deasphalted-extracted oil of the desired viscosity, aromatics content and Conradson Carbon residue content. In general, the amount of light hydrocarbon used will range from about 50 to 800 LV% of the feed, while the NMP with or without the presence of water will range from 50 to 400 LV% of the feed. More preferably, the light hydrocarbon will range from 400 to 600 LV% and the NMP from 150 to 250 LV% of the feed. Particularly preferred solvents for Middle East feedstocks include propane as the light hydrocarbon solvent and NMP with 1 LV% water as the polar solvent. Thus when using an Arab Light 600° F.+ resid as feedstock, the propane treat will preferably be 500 LV% and NMP treat about 200 LV%. The contacting step takes place at a temperature above about 50° F., but below the temperature of complete miscibility of the feed in the solvent and below the critical temperature of the light hydrocarbon. This temperature generally ranges from about 70° to 350° F., preferably from about 120° to about 190° F. and at a pressure ranging from about 10 to about 600 psig, and preferably from about 180 to about 500 psig. The exact conditions required will depend of course upon the particular solvent used and solvent/feed ratio. Further, it is not absolutely necessary to the operation of this invention, but it is preferable for the feed to be introduced into about the middle of the combination contacting zone (i.e., a deasphalting-extraction tower), the light hydrocarbon introduced at the bottom of said zone and the NMP with or without water introduced at the top thereof. This results in countercurrent solvent and oil flow which, under proper temperature and pressure conditions, effects phase separation to produce two liquid layers or phases, an upper layer or raffinate containing most of the hydrocarbon solvent along with the desired oil, and a lower layer or extract containing most of the NMP and water along with the asphaltenes and most of the aromatic and polar constituents of the oil.

The raffinate removed from the top of the combination deasphalting-extracting zone contains the desired lube oil along with most of the hydrocarbon solvent and an appreciable amount of NMP which must be removed therefrom and recycled back into the combination zone in order to make the process viable from both a practical and economic standpoint. Thus, the raffinate may contain as much as 65 wt. % NMP. This raffinate is heated and passed to a flash zone wherein most of the light hydrocarbon solvent contained therein is allowed to flash off and removed as vapor. Thus, the raffinate will be heated from a temperature ranging from about 180° to 450° F. and the flash zone will operate at a pressure ranging from about 40 to 500 psig. The light hydrocarbon solvent-reduced raffinate liquid produced in the flash zone will contain less than about 25 wt. % light hydrocarbon solvent and more preferably less than about 15 wt. %, with the remainder thereof being NMP and oil. The hydrocarbon solvent-reduced raffinate liquid is then chilled to a temperature sufficiently low to produce bulk liquid-liquid imiscibility between an NMP-rich phase and a lighter phase containing the desired lube oil. The temperature to which this hydrocarbon solvent-reduced raffinate liquid is chilled will, in general, range from about 80° to 250° F. with the chilled liquid then being passed to a separation zone wherein the two phases separate into a light upper layer or oil-rich phase containing most of the lube oil and a heavy phase or lower layer containing most of the NMP that was present in both the raffinate removed from the combination tower and the hydrocarbon solvent-reduced raffinate. In general, the light phase will contain at least 50% oil and no more than 35% NMP, with the lower phase containing at least 70% NMP with the remainder thereof being minor amounts of oil and light hydrocarbon solvent. The heavy phase which is mostly NMP is then recycled directly back into the combination zone as solvent.

The process of the instant invention may be used to simultaneously deasphalt-extract any mineral oil feedstock containing both asphaltene and aromatic components. Suitable feedstocks include whole crude oils, atmospheric and vacuum residua, and mixtures thereof having initial boiling points ranging from about 500° to about 1100° F. (at atmospheric pressure). Thus, both atmospheric residuum boiling above about 700° F. and vacuum residuum boiling above about 1050° F. can be treated by the process of the instant invention. Such feeds may come from Arabian, Light or Heavy crudes, Kuwait, Venezuelan and Western Canadian crudes such as Cold Lake and Athabasca bitumen, Bachaquero and the like. Atmospheric and vacuum resids from Aramco, Safaniya and Bachaquero are particularly suitable feedstocks as well as synthetic feedstocks derived from Athabasca Tar Sands, etc. The contacting of the feed with the deasphalting-extraction solvent may be carried out in one or more mixer-settler units or in one or more countercurrent liquid-liquid contacting towers. In the latter case, the feed enters the tower near the middle with the light hydrocarbon solvent entering near the bottom and the NMP with or without water entering near the top. The tower is provided with internals such as packing, staggered rows of angled irons, rotating disc contactors, liquid-liquid contacting trays, etc. to provide sufficient contacting of the solvent and feed. The asphaltic or extract phase passes through the tower countercurrently to the bulk of the rising stream of propane and leaves the bottom of the tower. The raffinate phase containing the desired deasphalted oil passes upward through the tower countercurrently to the bulk of the downcoming NMP and exits at the top of the tower.

BRIEF DESCRIPTION OF THE DRAWING

The FIGURE is a flow diagram of a preferred embodiment of the invention.

Referring to the drawing in detail, the asphalt and aromatics-containing oily feed is fed into the middle of combination zone 12 via line 10. NMP solvent containing from 0–5 LV% water is fed into the top of zone 12 via lines 14 and 16, while a liquid $C_2$–$C_{10}$ carbon atom hydrocarbon is introduced into the bottom of zone 12 via line 18. Extract containing most of the NMP, asphalt and aromatic components of the oily feed leaves the bottom of zone 12 via line 20. Raffinate, at a temperature ranging from about 120° to 190° F. and at a pressure of from about 180 to 500 psig, containing the desired lube oil along with most of the $C_2$–$C_{10}$ carbon atom hydrocarbon and some NMP leaves the top of zone 12 via line 22 and is passed through heat exchanger 24 wherein it is heated to a temperature of about 180° to 450° F. and then passed to flash zone 28 via line 26. Flash zone 28 operates at a pressure of about 40 to 500 psig and most of the $C_2$–$C_{10}$ carbon atom hydrocarbon present in the raffinate is flashed off in this zone leaving same as vapor via line 30 which results in producing a $C_2$–$C_{10}$ carbon atom hydrocarbon solvent-reduced raffinate. The hydrocarbon solvent-reduced raffinate leaves zone 28 via line 32 and is passed through heat exchanger 34 wherein it is cooled to a temperature of from about 80° to 250° F. which produces bulk-liquid immiscibility between the raffinate oil and the NMP, thereby forming two phases, an oil-rich light phase containing the desired raffinate lube oil and a heavy phase which is mostly NMP. After passing through cooler 34 the two phase liquid is passed to settling zone 38 wherein the oil-rich light phase separates from the heavier NMP-rich phase to produce an oil-rich upper layer and an NMP-rich lower layer. The oil-rich upper layer is removed from zone 38 via line 40 and sent to solvent recovery and/or further processing while the NMP-rich phase is removed from zone 38 and recycled directly back into zone 12 via lines 42 and 16.

DESCRIPTION OF THE PREFERRED EMBODIMENTS

The invention will be more clearly understood by reference to the following examples.

EXAMPLE 1

This example is a computer simulation of the NMP recovery-recycle portion of the FIGURE. Referring to the FIGURE, raffinate having the composition shown in Table I, at a temperature and pressure of 170° F. and 500 psig, respectively, is passed through heat exchanger 24 wherein it is heated to 325° F. and then passed into flash zone 28 which operates at a temperature and pressure of 325° F. and 275 psig, respectively. In zone 28 most of the propane is flashed off the raffinate as vapor to produce a propane-reduced raffinate. The propane vapor is removed via line 30, cooled and recycled back into zone 12 by means not shown. Compositions of the vapor stream and propane-reduced raffinate are shown in Table I. The propane reduced raffinate, amounting to about 44.5 wt.% of the raffinate entering zone 28 via line 26, is then passed through line 32 to heat exchanger 34 wherein it is cooled down to a temperature of 150° F. and is then passed to a settling zone 38 via line 36. Cooling the propane-reduced raffinate down to 150° F. creates two immiscible liquid phases, an oil-rich phase and an NMP-rich phase having the compositions shown in Table II. The amount of oil-rich and NMP-rich phases produced are 66.2 and 33.8 wt. % of the propane-reduced raffinate, respectively. The amounts of these phases produced and their compositions were obtained from a ternary diagram for raffinate oil, propane and NMP, derived following a standard technique such as that described in "Chemical Engineer's Handbook" ed. by R. H. Perry, Fifth Ed., pages 15–1. The raffinate oil used was a sample produced from Arab Light 680° F.+ residuum by pilot plant processing using propane and NMP in accordance with the instant invention.

TABLE I

| Composition, Wt. % | Raffinate | Propane-reduced Raffinate | Vapor From Flash Zone |
|---|---|---|---|
| NMP | 21.07 | 44.36 | 2.37 |
| Oil | 18.72 | 42.02 | — |
| Propane | 60.21 | 13.62 | 97.63 |

TABLE II

| Composition, Wt. % | Oil-Rich Phase | NMP-Rich Phase |
|---|---|---|
| NMP | 30.0 | 72.5 |
| Oil | 54.5 | 17.5 |
| Propane | 15.5 | 10.0 |

In settling zone 38 the oil-rich phase containing the desired raffinate oil separates from the NMP-rich phase and, being lighter, raises to the top as a layer, is removed via line 40 and sent to solvent recovery and/or further processing. The NMP-rich phase settles out as a lower layer, is removed via line 42 and recycled back into zone 12 via lines 42 and 16.

Thus, it can be seen that 51.74% of the NMP solvent in the raffinate produced in zone 12 is recycled back into the combination deasphalting-extracting zone without having to separate same from the raffinate via a vaporization or distillation operation.

EXAMPLE 2

In this example, pilot plant runs were made on an Arabian Light atmospheric resid having an initial boiling point of 750° F.+ and an API gravity of 16. This feed was fed into the middle of a solvent deasphalting-extraction tower, with propane fed into the bottom of the tower and a polar solvent selected from the group consisting essentially of phenol, NMP or NMP containing 2 LV% water was fed into the top of the tower. The operating conditions in the tower were a pressure of 500 psig and a temperature ranging between about 131° and 162° F., as shown in Table III. This produced a deasphalted oil raffinate and an asphaltic extract, the raffinate being removed from the top of the tower and the extract from the bottom. Solvent was removed from the resulting raffinate and asphaltic extract with the properties of the recovered, solvent-free deasphalted oil and asphalt shown in Table III.

TABLE III

PILOT PLANT RUNS USING PHENOL OR NMP IN COMBINATION WITH PROPANE

| POLAR SOLVENT | PHENOL | NMP | NMP + 2 LV% $H_2O$ |
|---|---|---|---|
| OPERATING CONDITIONS | | | |
| Pressure, psig | — | 500 | — |
| Temperature, ° F | | | |
| Top of Tower | 151 | 134 | 162 |
| Bottom of Tower | 131 | 125 | 140 |
| TREAT RATE, LV | | | |
| Polar Solvent/Feed | 0.9/1 | 0.9/1 | 1.1/1 |
| Propane/Feed | 4.5/1 | 4.2/1 | 3.5/1 |
| RAFFINATE | | | |
| Yield, LV% | 67 | 72 | 70 |
| Gravity, API | 24.7 | 24.6 | 24.6 |
| Conradson Carbon, Wt.% | 0.8 | 0.6 | 0.7 |
| ASPHALT | | | |
| Specific Gravity | 1.07 | 1.10 | 1.09 |
| Softening Point, ° F (ASTM D 2398-71) | 120 | 154 | 130 |

These results show that not only was less solvent required using a propane/NMP solvent, but the yield of deasphalted oil was unexpectedly greater than the yield obtained using phenol, and further, the propane/NMP produced asphalt was harder. Therefore, valuable heavy lubes are not lost to the asphalt as in the propane/phenol case.

EXAMPLE 3

In this experiment, the feed was a Light Arab 680° F.+ atmospheric resid which was treated on a batch basis using NMP and propane/NMP as the solvent for the simultaneous deasphalting-extraction. The properties of the feed and solvent-free, deasphalted oils are listed in Table IV. The NMP deasphalting-extraction was accomplished using three treats of 200 LV% each (based on the feed) for a total treat of 600 LV% NMP. The deasphalting-extraction accomplished using propane/NMP employed only one treat with a total solvent treat (propane plus NMP) of 550 LV% based on the feed.

TABLE IV

BATCH TREATMENT OF ARAB LIGHT 680° F + RESIDUUM

| SOLVENT | NMP | Propane-NMP |
|---|---|---|
| OPERATING CONDITIONS | | |
| Propane Treat, LV% | — | 390 |
| Number of Treats | 3 | 1 |
| Total NMP Treat, LV% | 600 | 160 |
| Water Content of NMP, LV% | 1 | 1.2 |
| Temperature, ° C | 88 | 77 |
| Pressure, psig | 0 | 380 |

| REFINED OIL PROPERTIES | Arab Light 360° C + FEED | | |
|---|---|---|---|
| Yield, LV% | 100 | 30 | 55 |
| Density, kg/dm$^3$, 15° C | 0.9530 | 0.9121 | 0.9095 |
| Viscosity, cSt/98.9° C | 24.3 | — | — |
| Refractive Index at 75° C | 1.5190 | 1.4890 | — |

The data in Table IV show that a greater yield of higher quality deasphalted oil was obtained using propane/NMP compared to using NMP alone, even though the total solvent treat and the number of treats were less.

EXAMPLE 4

This example demonstrates the usefulness of this invention for removing aromatic components from the oil. In this experiment an Arab Light 750° F.+ resid was simultaneously deasphalted and solvent extracted using both propane and propane/NMP, with the NMP containing 2 LV% $H_2O$. The properties of the feed and the solvent-free deasphalted-extracted oils are listed in Table V.

The data show that simultaneously deasphalting-extracting the feed with the propane/(NMP + 2 LV% $H_2O$) solvent produced a raffinate oil with an aromatics content of 33 wt.% compared to the 46 wt.% aromatics content of the feed.

TABLE V

COMPOSITIONAL CHANGES ACROSS PROPANE AND PROPANE/NMP TREATING

| TREATING SOLVENT | — | Propane | Propane/NMP + 2 LV% $H_2O$ |
|---|---|---|---|
| OPERATING CONDITIONS | | | |
| Pressure, psig | — | 500 | — |
| Temperature, ° F | | | |
| Top of Tower | 170 | | 162 |
| Bottom of Tower | 150 | | 140 |
| TREAT RATE, LV | | | |
| NMP/Feed | | — | 1.1/1 |
| Propane/Feed | | 6.9/1 | 3.5/1 |
| RAFFINATE | (Feed) | | |
| Yield, LV% | (100) | 74 | 70 |
| Gravity, API | (15.9) | 22.5 | 24.6 |
| Conradson Carbon, wt.% | (9.1) | 1 | 0.7 |
| Silica Gel Analyses, | | | |
| Saturates, wt.% | (40) | 49 | 56 |
| Aromatics, wt.% | (46) | 40 | 33 |
| Polars, wt.% | (9) | 4 | 4 |
| Recovery, wt.% | (95) | 93 | 93 |

What is claimed is:

1. A process for simultaneously solvent-deasphalting and extracting a mineral oil feedstock containing asphaltic and aromatic components which comprises the steps of:

(1) contacting said feedstock in a combination deasphalting-extracting zone with a solvent comprising a mixture of (a) NMP containing from 0–5 LV% water and (b) one or more liquid, low molecular weight $C_2$–$C_{10}$ carbon atom hydrocarbons to form two layers or phases, an upper raffinate phase containing the desired oil, most of the hydrocarbon solvent and some NMP and a lower, extract layer or phase containing asphalt and most of the NMP;

(2) removing the raffinate from said combination zone and heating same to a temperature ranging from between 180° to 450° F.;

(3) passing said hot raffinate from step (2) to a flash zone to remove most of the hydrocarbon solvent therefrom as vapor to produce a hydrocarbon solvent-reduced raffinate;

(4) chilling said hydrocarbon solvent-reduced raffinate to a temperature sufficiently low to produce bulk liquid-liquid immiscibility between the raffinate oil and the NMP, thereby forming two phases or layers, an oil-rich light phase and an NMP-rich heavy phase containing some oil and most of the NMP present in the raffinate formed in step (1) above;

(5) separating the oil-rich phase from the NMP-rich phase; and (6) passing said NMP-rich phase back into said combination zone.

2. The process of claim 1 wherein said contacting step is conducted at a temperature ranging from about 70° to about 350° F., at a pressure ranging from about 10 to about 600 psig.

3. The process of claim 2 wherein said contacting step is conducted at a solvent-to-oil ratio ranging from about 50 to 800 LV% for the hydrocarbon and from about 50 to 400 LV% for the NMP.

4. The process of claim 3 wherein the mineral oil is a petroleum oil having an initial boiling point ranging from about 500° to about 1050° F. at atmospheric pressure.

5. The process of claim 4 wherein said raffinate is heated to a temperature ranging between about 180° to 450° F. before being passed to said flash zone.

6. The process of claim 5 wherein said flash zone operates at a temperature and pressure ranging from about 180° to 450° F. and 40 to 500 psig, respectively.

7. The process of claim 6 wherein said hydrocarbon-solvent reduced raffinate produced in said flash zone is cooled to a temperature below about 250° F. before being passed to said settling zone.

8. The process of claim 7 wherein said oil is a resid having an initial boiling point ranging from about 700° F.+ to about 1100° F.+ at atmospheric pressure.

9. The process of claim 8 wherein said hydrocarbon solvent is propane.

10. The process of claim 9 wherein said NMP contains from about 0–2 LV% water.

11. A simultaneous solvent-deasphalting-extracting process for a heavy petroleum oil feed selected from the group consisting essentially of crude oils, atmospheric resids and vacuum resids containing both asphaltic and aromatic components, which comprises the steps of:

(1) contacting said feed in a combination deasphalting-extracting zone, at a temperature and pressure ranging from about 120°–190° F. and 180–500 psig, respectively, with a solvent comprising a mixture of (a) NMP containing from 0–5 LV% water, (b) one or more liquid, low molecular weight $C_2$–$C_{10}$ carbon atom hydrocarbons to form two layers or phases, an upper raffinate phase containing the desired oil, most of the hydrocarbon solvent and some NMP and a lower, extract layer or phase containing most of the NMP and water along with the asphaltenes and most of the aromatic and polar components of the feed;

(2) removing the raffinate from said combination zone and heating same to a temperature ranging from between 180° to 450° F.;

(3) passing said hot raffinate from step (2) to a flash zone to remove most of the hydrocarbon solvent therefrom as vapor and produce a hydrocarbon solvent-reduced raffinate;

(4) chilling said hydrocarbon solvent-reduced raffinate to a temperature sufficiently low to produce bulk liquid-liquid immiscibility between the raffinate oil and the NMP, thereby forming two phases or layers, an oil-rich light phase and an NMP-rich heavy phase containing some oil and most of the NMP present in the raffinate formed in step (1) above;

(5) separating the oil-rich phase from the NMP-rich phase; and (6) passing said NMP-rich phase back into said combination zone.

* * * * *

UNITED STATES PATENT OFFICE

CERTIFICATE OF CORRECTION

PATENT NO. : 4,125,458

DATED : November 14, 1978

INVENTOR(S) : Bushnell, Glivicky, Leighton, Sankey

It is certified that error appears in the above-identified patent and that said Letters Patent are hereby corrected as shown below:

On the Cover Page, delete item 63, Column 1, delete lines 4 through 10.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*